United States Patent [19]

Maile, Jr.

[11] Patent Number: 4,917,823

[45] Date of Patent: Apr. 17, 1990

[54] STABLE AND EASILY RINSEABLE LIQUID CLEANSING COMPOSITIONS CONTAINING CELLULOSIC POLYMERS

[75] Inventor: Robert J. Maile, Jr., Cincinnati, Ohio

[73] Assignee: The Procter & Gamble Company, Cincinnati, Ohio

[21] Appl. No.: 277,463

[22] Filed: Nov. 23, 1988

Related U.S. Application Data

[63] Continuation of Ser. No. 921,905, Oct. 24, 1986, abandoned, which is a continuation of Ser. No. 625,407, Jun. 28, 1984, abandoned.

[51] Int. Cl.[4] ..... C11D 1/12; C11D 3/37; C11D 17/08

[52] U.S. Cl. ..... 252/548; 252/162; 252/173; 252/174.17; 252/174.23; 252/552; 252/555; 252/557; 252/558; 252/DIG. 2; 252/DIG. 14

[58] Field of Search ..... 252/178.18, 178.21, 252/558, 547, 531, 548, 551, DIG. 5, DIG. 13, 174.23, 162

[56] References Cited

U.S. PATENT DOCUMENTS 4,472,297 9/1984 Bolich, Jr. et al. ..... 252/531
4,617,148 10/1986 Shields ..... 252/550

*Primary Examiner*—Paul Lieberman
*Assistant Examiner*—John F. McNally
*Attorney, Agent, or Firm*—Leonard Williamson; Robert B. Aylor; Richard C. Witte

[57] ABSTRACT

Liquid cleansing compositions which are cosmetically attractive, stable and which also have excellent performance properties. The compositions contain a water-soluble cellulose polymer, a solvent, a synthetic surfactant, and water as essential components and have a neat viscosity (100%) of 2,000 to 12,000 cps and a dilute viscosity (50%) of 15 to 95 cps. The compositions also contain a very low level of electrolytes.

11 Claims, 1 Drawing Sheet

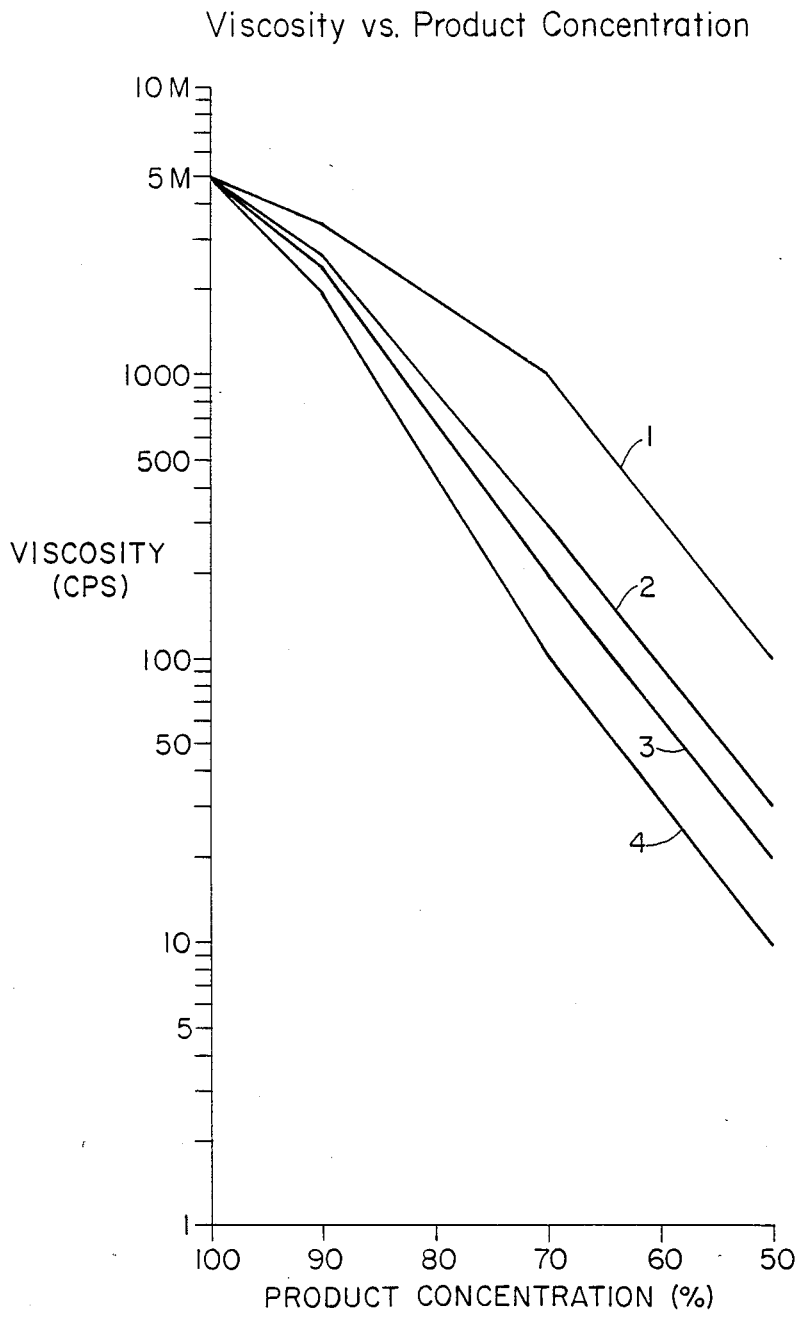
Viscosity vs. Product Concentration
10 M
5 M
1000
500
100
50
10
5
1
VISCOSITY
(CPS)
1
2
3
4
100
90
80
70
60
50
PRODUCT CONCENTRATION (%)

STABLE AND EASILY RINSEABLE LIQUID CLEANSING COMPOSITIONS CONTAINING CELLULOSIC POLYMERS

This is a continuation of application Ser. No. 921,905, filed Oct. 24, 1986; which is a continuation of application Ser. No. 625,407, filed June 28, 1984, now abandoned.

TECHNICAL FIELD

The present invention is related to lqiuid cleansing products, especially bath/shower compositions which contain a cellulose polymer as a thickening/skin feel aid and a solvent for viscosity control and phase stability.

BACKGROUND ART

The use of thickeners in lqiuid personal cleansing compositions is well known. U.S. Pat. Nos. disclosing such compositions are 3,697,644, October 10, 1972 to Laiderman; 3,932,610, January 13, 1976 to Rudy et al.; 4,031,306, June 21, 1977 to DeMartino et al.; and 4,061,602, December 6, 1977 to Oberstar et al.

It is also known that liquid personal cleaning products can be thickened by:

a. Using polymeric additives that hydrate, swell or molecularly associate to provide body (e.g., hydroxypropl guar gum is used as a thickening aid in shampoo compositions).

b. Using a combination of Carbopol (an acrylic acid polymer) and guar gum derivatives (e.g., using combinations of Carbopol and Jaguar HP-60 gum/guar gum derivatives to provide thickening and soft silky skin feel, as well as shelf stability).

c. Adding electrolytes, such as using NaCl to swell micelles to provide body.

While it is known to use thickeners in liquid cleansing compositions, there is no teaching or suggestion of certain problems encountered with cellulose polymers in making stable, good performing liquid cleansing bath/-shower compositions, or solutions thereto.

Specifically, there are no suggestions for incorporating the solvents used in this invention into such compositions to obtain satisfactory stable products.

It is, therefore, an object of the present invention to provide cellulose polymers containing liquid cleansing bath/shower compositions which are phase stable and cosmetically attractive.

It is a further object of the present invention to provide liquid cleansing compositions which are clear as well as stable.

It is still a further object of the present invention to provide liquid cleansing compositions which delivery satisfactory skin feel and rinse properties.

These and other objects of the present invention will become obvious from and the detailed description which follows.

BRIEF DESCRIPTION OF THE FIGURE

The FIGURE shows four viscosity curves for five products vs. product concentration. Curve 1 represents Example A; Curve 2 represents Example II; Curve 3 represents Examples I (same as Example B) and III; and Curve 4 Example C. The five product formulations are found in the examples.

Curve 1 represents a product which has a high degree of slipperiness but is difficult to rinse. Curves 2 and 3 represent products which have the desired degree of slipperiness and ease of rinsing. Curve 4 represents a product which has a low degree of slipperiness, but which is easy to rinse.

SUMMARY OF THE INVENTION

The present invention relates to liquid cleansing compositions comprising from about 0.1% to about 1.5% of a water-soluble cellulose polymer consisting of hydroxymethyl-, hydroxyethyl-, hydroxypropyl-, hydroxybutyl methyl-, carboxymethyl cellulose, and the like, from about 0.5% to about 20% of a solvent consisting of ethylene glycol or propylene glycol (the monomers) or polyoxyethylene glycol or polyoxypropylene glycol (considered as polymeric forms of ethylene glycol and propylene glycol, respectively) or the mixed block copolymers of polyoxyethylene glycol and polyoxypropylene glycol and mixtures thereof, from about 10% to about 50% of a synthetic surfactant, and from about 50% to about 80% of water. The liquid cleansing compositon has a neat (100%) viscosity of 2,000–12,000 cps and a dilute (50%) viscosity of 15–95 cps. The compositions must contain less than 1% electrolyte.

DETAILED DESCRIPTION OF THE INVENTION

An important attribute of a personal cleansing product is the feel of the product in use. This feel can be described as soft, silky and slippery. Another important attribute is the ease of rinsing of the product while in use. A poor rinsing product can be described as one in which there is a prolonged feeling of slipperiness and slickness during the rinsing process.

It has been discovered that the slipperiness and ease of rinsing of a product can be related in part to the viscosity of the solution of the product in water as it is diluted. This can be used to help described products which have the desired level of skin feel and ease of rinsing characteristics for certain end uses. The desired product must then be formulated to provide the desired dilute viscosity curve which controls skin feel and rinsing in use, the desired neat viscosity, the desired amount of lather in use and a stable product that does not separate or change in neat viscosity while stored.

It has been found that products with high dilution viscosity curves are desirable to most women and disliked by most men because the product imparts a high degree of slipperiness and silkiness, i.e., suitable for feminine use but not by both sexes. In addition, these products are difficult to rinse for the same reaons. On the other hand, products that have low dilution viscosity curves provide insufficient silky, slippery feel for both men and women, but are very ease to rinse.

This invention relates to shelf stable products with desirable neat viscosity, using selected thickeners, e.g., hydroxyethyl cellulose, and selected solvents, e.g., polyoxytehylene or propylene glycol. THe products are stable and provide a desirable level of skin feel for both mean and women by controlling the viscosity upon dilution relationships.

It is known to use Jaguar HP-60 polymer (hydroxypropyl guar gum, molar substitution =0.6) in a personal cleansing product. This provides a high dilution viscosity curve desirable to most women and undesirable to most men. It is also known to use a combination of Carbopol and Jaguar HP-60 and other guar gum derivatives which provide soft silky skin feel that are shelf stable. These formulations though do not provide the desired dilute viscosity and control of skin feel achieved in this development.

The terms "Neat Vicosity" and "Dilute Viscosity" as used herein are defined according to the method taught herein, unless otherwise indicated.

Cellulosic Thickeners

The cellulosic thickeners in this invention are categorized as nonionic or anionic and are selected to provide the desired viscosities. Suitable cellulosic thickeners are listed in the Glossary and Chapters 3, 4, 12 and 13 of the *Handbook of Water-Soluble Gums and Resins,* Robert L. Davidson, McGraw-Hill Book Co., New York, N.Y., 1980, incorporated by reference herein.

The nonionic cellulosic thickeners include, but are not limited to, the following polymers;

1. hydroxyethyl cellulose;
2. hydroxymethyl cellulose;
3. hydroxypropyl cellulose; and
4. hydroxybutyl methyl celulose.

The anionic cellulosic thickener includes carboxymethyl cellulose and the like.

The preferred thickener is hydroxyethyl cellulose, which is made by treating cellulose with sodium hydroxide and reacting with ethylene oxide. Hydroxyethyl groups (molar substitution 1.5 to 3, preferably 2 to 3) are introduced to yield a hydroxyethyl ether. The reaction product is purified and ground to a fine white powder.

The amount of cellulosic thickener found useful in the present compositions is about 0.1% to about 1.5%, preferably from about 0.1% to about 1.0%. The thickeners are used in combination with the solvent to produce the neat and dilute viscosities of 2,000 to 12,000 cps and 15 to 95 cps, respectively, preferably 4,000 to 10,000 cps and 20 to 60 cps, respectively.

Solvent

A second essential component of the present compositions is solvent consisting of ethylene glycol or propylene glycol (the monomers) or polyoxyethylene glycol or polyoxypropylene glycol (considered as a polymeric form of ethylene glycol or propylene glycol) or the mixed blcok copolymers of polyoxyethylene glycol and polyoxypropylene glycol and mixtures thereof. The polymeric forms of solvent have an average molecular weight in the range of from about 200 to about 10,000, preferably 400 to 800. The solvent is present at a level of from about0.5% to abotu 20%, preferably from about 1% to about 10% in the present compositions.

Surfactant

The third essential component of the present compositions is a surfactant. The surfactant, which may be selected from any of a wide variety of anionic (nonsoap), amphoteric, zwitterionic, nonionic and, in certain instances, cationic surfactants, is present in a level of from about 10% to about 50%, preferably from about 10% to about 30%.

Anionic nonsoap surfactants can be exemplified by the alkali metal salts of organic sulfuric reaction products having in their molecular structure an alkyl radical containing from 8 to 22 carbon atoms and a sulfonic acid or sulfuric acid ester radical (included in the term alkyl is the alkyl portion of higher acyl radicals). Preferred are the sodium ammonium, potassium or triethanolamine alkyl sulfates, especially those obtained by sulfating the higher alcohols ($C_8$–$C_{18}$ carbon atoms), sodium coconut oil fatty acid monoglyceride sulfates and sulfonates; sodium or potassium salts of sulfuric acid esters of the reaction product of 1 mole of a higher fatty alcohol (e.g., tallow or cocont oil alcohols) and 1 to 12 moles of ethylene oxide; sodium or potassium salts of alkyl phenol ethylene oxide ether sulfate with 1 to 10 units of ethylene oxide per molecule and in which the alkyl radicals contain from 8 to 12 carbon atoms, sodium alkyl glyceryl ether sulfonates; the reaction product of fatty acids having from 10 to 22 carbon atoms esterified with isethionic acid and neutralized with sodium hydroxide; water soluble salts of condensation products of fatty acids with sarcosine; and others known in the art.

Nonionic surfactants can be broadly defined as compounds produced by the condensation of alkylene oxide groups (hydrophiic in nature) with an organic hydrophobic compound, which may be aliphatic or alkyl aromatic in nature. Examples of preferred classes of nonionic surfactants are:

1. The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts euqal to 10 to 60 moles of ethylene oxide per mole of alkyl phenol. The alkyl substituent in such compounds may be derived from polymerized propylene, diisobutylene, octane, or nonane, for example.

2. Those derived from the condensation of ethylene oxide with the product resulting from the reaction of prpylene oxide and ethylene diamine products which may be varied in composition depending upon the balance between the hydrophobic and hydrophilic elements which is desired. For example, compounds containing from about 40% to about 80% polyoxyethylene by weight and having a molecular weight of from about 5,000 to about 11,000 resulting from the reaction of ethylene oxide groups with a hydrophobic base constituted of the reaction product of ethylene diamine and excess propylene oxide, said base having a molecular weight of the order of 2,500 to 3,000, are satisfactory.

3. The condensation product of aliphatic alcohols having from 8 to 18 carbon atoms, in either straight chain or branched chain configurations with ethylene oxide, e.g., a coconut alcohol ethylene oxide condensate having from 10 to 30 moles of ethylene oxide per mole of coconut alcohol, the coconut alcohol fraction having from 10 to 14 carbon atoms. Other ethylene oxide condensation products are ethoxylated fatty acid esters of polyhydric alcohols (e.g., Tween 20-polyoxyethylene (20) sorbitan monolaurate).

4. Long chain tertiary amine oxides corresponding to the following general formula:

$$R_1R_2R_3N \rightarrow O$$

wherein $R_1$ contains an alkyl, alkenyl or monohydroxy alkyl radical of from about 8 to about 18 carbon atoms, from 0 to about 10 ethylene oxide moieties, and from 0 to 1 glyceryl moiety, and $R_2$ and $R_3$ contain from 1 to about 3 carbon atoms and from 0 to about 1 hydroxy group, e.g., methyl, ethyl, propyl, hydroxy ethyl, or hydroxy propyl radicals. The arrow in the formula is a conventional representation of a semipolar bond. Examples of amine oxides suitable for use in this invention include diemethyldodecylamine oxide, oleyldi(2-hydroxyethyl) amine oxide, dimethyloctyalmine oxide, dimethyldecylamine oxide, dimethyltetradecylamine oxide, 3,6,9-trioxaheptadecyldiethylamine oxide, di(2-hydroxyethyl)tetradecylamine oxide, 2-dodecoxyethyldimethylamine oxide, 3-dodecoxy-2-hydroxypropyldi(3-hydroxypropyl)amine oxide, dimethylhexadecylamine oxide.

5. Long chain tertiary phosphine oxides corresponding to the following general formula:

$$RR'R''P \rightarrow O$$

wherein R contains an alkyl, alkenyl or monohydroxyalkyl radical ranging from 8 to 18 carbon atoms in chain length, from 0 to about 10 ethylene oxide moieties and from 0 to 1 glyceryl moiety and R′ and R″ are each alkyl or monohydroxyalkyl groups containing from 1 to 3 carbon atoms. The arrow in the formula is a conventional representation of a semipolar bond. Examples of suitable phosphine oxides are: dodecyldimethylphosphine oxide, tetradecylmethylethylphosphine oxide, 3,6,9-trixoaoctadecyldimethylphosphine oxide, cetyldimethylphosphine oxide, 3-dodecoxy-2-hydroxypropyldi(2-hydroxyethyl) phosphine oxide steryldimethylphosphine oxide, cetylethylpropylphosphine oxide, oleyldiethylphosphine oxide, dodecyldiethylphosphine oxide, tetradecyldiethylphosphine oxide, dodecyldipropylphosphine oxide, dodecyldi(hydroxymethyl)phosphine oxide, dodecyldi(2-hydroxyethyl)phosphine oxide, tetradecylmethyl-2-hydroxypropylphosphine oxide, eleyldimethylphosphine oxide, 2-hydroxydodecyldimethylphosphine oxide.

6. Long chain alkyl sulfoxides containing one short chain alkyl or hydroyx alkyl radical of 1 to about 3 carbon atoms (usually methyl) and one long hydrophobic chain which contain alkyl, alkenyl, hydroxy alkyl, or keto alkyl radicals containing from about 8 to about 20 carbon atoms, from 0 to about 10 ethylene oxide moieties and from 0 to 1 glyceryl moiety. Examples include: octadecyl methyl sulfoxide, 2-ketotridecyl methyl sulfoxide, 3,6,9-trioxaoctadecyl 2-hydroxyethyl sulfoxide, dodecyl methyl sulfoxide, oleyl 3-hydroxypropyl sulfoxide, tetradecyl methyl sulfoxide, 3-methoxytridecyl methyl sulfoxide, 3-hydroxytridecyl methyl sulfoxide, 3-hydroxy-4-dodecoxybutyl methyl sulfoxide.

Zwitteronic surfactants can be exemplified by those which can be braodly described as derivatives of aliphatic quaternary ammonium, phosphonium, and sulfonium compounds, in which the aliphatic radicals can be straight chain or branched and wherein one of the aliphatic substituents contains from about 8 to 18 carbon atoms and one contains an anionic water-solubilizing group, e.g., carboxy, sulfonate, sulfate, phosphate, or phosphonate. A general formula for these compounds is:

$$R^2\text{-}\overset{(R^3)_x}{\overset{|}{Y}}{}^{(+)}\text{—}CH_2\text{-}R^4\text{-}Z^{(-)}$$

wherein $R^2$ contains an alkyl, alkenyl, or hydroxy alkyl radical of from about 8 to about 18 carbon atoms, from 0 to about 10 ethylene oxide moieties and from 0 to 1 glyceryl moiety; Y is selected from the group consisting of nitrogen, phosphorus, and sulfur atoms; $R^3$ is an alkyl or monohydroxyalkyl group containing 1 to about 3 carbon atoms; X is 1 when Y is a sulfur atom and 2 when Y is a nitrogen orphosphorus atom; $R^4$ is an alkylene or hydroxyalkylene of from 1 to about 4 carbon atoms and Z is a radical selected from the group consisting of carboxylate, sulfonate, sulfate, phosphonate, and phosphate groups.

Examples include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3=[P,P-P-diethyl-P-3,6, 9-trixoatetradexocylphosphonio]-2-hydroxypropane-1-phosphate; 3-[N,N-dipropyl-N-3-dodecoxy-2-hydroxypropylammonio]-propane-1-phosphonate; 3-(N,N-dimethyl-N-hexadecylammonio)propane-1-sulfonate; 3-(N,N-dimethyl-N-hexadecylammonio)-2-hydroxypropane-1-sulfonate; 4-[N,N-di(2-hydroxyethyl)-N-(2-hydroxydodecyl)ammonio]-butane-1-carboxylate; 3-[S-ethyl-S-(3-dodecoxy-2-hydroxyproyl)sulfonio]-propane-1-phosphate; 3-(P,P-dimethyl-P-dodecylphosphonio)-propane-1-phosphonate; and5-[N,N-di(3-hydroxypropyl)-N-hexadecylammonio]-2-hydroxy-pentane-1-sulfate.

Examples of amphoteric surfactants which can be used in the compositions of the present invention are those which can be broadly described as derivatives of aliphatic secondary and tertiary amines in which the aliphatic radical can be straight chain or branched and wherien one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecylaminopropionate, sodium sodium 3-dodecylaminopropane sulfonate, N-alkyltaurines, such as the one prepared by reacting dodecylamine with sodium isethionate according to the teacing of U.S. Pat. No. 2,658,072, N-higher alkyl aspartic acids, such as those produced according to the teaching of U.S. Pat. No. 2,438,091, and the products sold under the trade name "Miranol" and described in U.S. Pat. No. 2,528,378. Other amphoterics such as betaines are also useful in the present composition.

Examples of betaines useful herein include the high alkyl betaines such as coco dimethyl carboxymethyl betaine, lauryl dimethyl carboxymethyl betaine, lauryl dimethyl alpha-carboxyethyl betaine, cetyl dimethyl carboxymethyl betaine, lauryl bis(2-hydroxyethyl)carboxy methyl betaine, stearyl bis-(2-hydroxypropyl) carboxymethyl betaine, oleyl dimethyl gamma-carboxypropyl betaine, lauryl bis-(2-hydroxypropyl) alpha-carboxyethyl betaine, etc. The sulfo-betaines may be represented by coco dimethyl sulfopropyl betaine, stearyl dimethyl sulfopropyl betaine, lauryl bis-(2-hydroxyethyl) sulfopropyl betaine, amido betaines amidosulfobetaines, and the like.

Many cationic surfactants are known to the art. By way of example, the following may be mentioned:
stearyldimethylbenzyl ammonium chloride;
dodecyltrimethylammonium chloride;
nonylbenzylethyldimethyl ammonium nitrate;
tetradecylpyridinium bromide;
lauryl pyridinium chloride;
cetylpyridinium chloride;
laurylpyridinium chloride;
laurylisoquinolium bromide;
ditallow(hydrogenated dimethyl ammonium chloride;
dilauryldimethyl ammonium chloride; and
stearalkonium chloride.

Many additional nonsoap surfactants are described in McCUTCHEON'S, DETERGENTS AND EMULSUFIERS, 1979 ANNUAL published by Allured Publishing Corporation, which is incorporated here by reference.

The above-mentioned surfactants can be used in the liquid cleansing bath/shower compositions of the present invention. The anionic surfactants, particularly the alkyl sulfates, the ethoxyanionic surfactants, particularly the alkyl sulfates, the ethoxylated alkyl sulfates and mixtures thereof are preferred. More preferred are anionic surfactants selected from the group consisting of sodium alkyl glycerol ether sulfonate, sodium lauroyl sarcosinate, sodium alkyl sulfate, sodium ethoxy (3) alkyl sulfate, and mixtures thereof.

Electrolyte

An additional requirement of the present compositions is that they contain a low level of electrolyte. Electrolytes include inorganic salts (e.g., sodium chloride) as well as organic salts (e.g., sodium citrate). The amount of electrolyte varies with the type of surfactant but should not be present in finished product at a level greater than 1.0%, preferably as little as possible and less than 0.5%. In addition to the above-mentioned chloride and citrate salts, other salts include phosphates, sulfates and other halogen ion salts. The counter ions of such salts can be sodium or other monovalent cations as well as di- and trivalent cations. It is recognized that these salts may cause instability if present at greater than 1.0% levels.

Aqueous Carrier

The liquid cleansing bath/shower compositions herein are in the form of liquids in which water is the principal diluent. The level of water in the compositions is typically from about 50% to about 80%.

Optional Components

The liquid cleansing bath/shower compositions can contain a variety of nonessential optinal ingredients suitable for rendering such compositions more desirable. Such conventional optional ingredients are well known to those skilled in the art, e.g., preservatives such as benzyl alcohol, methyl paraben, propyl paraban and imidazolidinyl urea; other thickeners and viscosity modifiers such as $C_8$–$C_{18}$ ethanolamide (e.g., coconut ethanolamide) and polyvinyl alcohol; skin moisturizers such as glycerine; pH adjusting agents such as citric acid, succinic acid, phosphoric acid, sodium hydroxide, etc.; suspending agents such as magnesium/aluminm silicate; perfumes; dyes; and sequestering agents such as disodium ethylenediamine tetraacetate.

One preferred form of the present compositions is a clear product. However, if desired, a pearlescer such as ethylene glycol distearate may be used to give the product a pearlescent effect.

A preferred liquid cleansing product contains from about 1% to about 5% of an alkanolamide of a fatty acid having from about 8 to about 18 carbon atoms.

If present, the optional components individually generally comprise from about 0.001% to 10.0% by weight of the composition. The pH of the lqiuid cleansing bath/shower compositions herein is generally from about 3 to about 9, preferably from about 5 to about 8.

Method of Manufacture

The liquid cleansing compositions of the present invention may be made using techniques well known in the art. A suitable method is shown in Example 1.

Industrial Applicability

The liquid cleansing compositions are useful as a cleansing aid for the entire body. The basic invention of a cellulose polymer thickener and solvent may also be applicable in other liquid type products such as liquid hand soaps and light duty dishwashing liquids that require a certain degree of skin feel.

METHOD I—NEAT VISCOSITY (100% PRODUCT)

Operation: (Brookfiedl LVF-Type Viscometer)

Pour approximately 140g of the finished product into a 150 ml beaker taking care to avoid trapping air bubbles. Check the product temperature with the thermometer—the temperature should be between 74.5°–75.5° F. If not, a warm water or a cold water bath must be used to adjust the temperature. A common galvanized laboratory tray (depth of approximatley 2½ inches) may be used. Temperatures of the baths should be 60°–65° F. for the cold and 85°–90° F. for the warm water. Place the beaker in the bath and stir sample gently with the thermometer, taking care to avoid generation of air bubbles. The sample is ready for analysis when a uniform temperature of 74.5°–75.5° F. exists throughout the sample. Attach spindle #4 to the viscometer. While the temperature of the sample is within the limits, carefully lower viscometer spindle #4 into the beaker. The spindle guard should *not* be attached. (Note: It is important that the spindle temperature is equilibrated to room temperature before inserting into the sample; allow at least 15 minutes for temperature equilibrium after washing spindle.) Do not lower the spindle below the depth notch. If this occurs, raise the spindle and carefully wipe the shaft above the notch, then reinsert the spindle into the sample. Center the spindle in the beaker with the surface of the sample in the center of the spindle depth notch. Start the viscometer motor, set at 30 rpm's, wait 15 seconds, then take a meter reading. Take two additional readings. Refer to the Brookfield visometer manual for proper operation.

Calculations:

Calculate the viscosity of the sample as follows:

$$\text{Viscosity} = A \times 200$$

A = Average of the three meter readings.

200 = Convesion factor found in the Brookfield manual for spindle #4 @ 30 rpm's.

NOTE: When reporting the viscosity of the solution, always include the temperature 74.5°–75.5° F. (23.6°–24.2° C.).

METHOD II—DILUTE VISCOSITY (50% Product/50% Water)

Operation: (Brookfield LVF-Type Viscometer)

Pour 175g of finished product and 175g of distilled water into a 400 ml beaker. Mix by hand with stirring rod taking care to avoid air bubbles. Check the solution temperature with the thermometer—the temperature should be between 74.5°–75.5° F. If not, a warm water of a cold water bath must be used to adjust the temperature. A common galvanized laboratory tray (depth of approximatley 2½ inches) may be used. Temperatures of the baths should be 60°–65° F. for the cold and 85°–90° F. for the warm water. Place the beaker in the bath and stir sample gently with the thermometer, taking care to avoid generation of air bubbles. The sample is ready for analysis when a uniform temperature of 74.5°–75.5° F. exists throughout the sample. Attach spindle #1 to the viscometer. While the temperature of the sample is within the limits, carefully lower viscometer spindle #1 in the beaker. The spindle guard should *not* be attached. (Note: It is important that the spindle temperature is equilibrated to room temperature before inserting into the sample; allow at least 15 minutes for temperature equilibration after washing spindle.) Do not lower the spindle below the depth notch. If this occurs, raise the spindle and carefully wipe the shaft above the notch, then reinsert the spindle into the sample. Center the spindle in the beaker with the surface of the sample in the center of the spindle depth notch. Start the viscometer motor, set at 30 rpm's, wait 15 seconds, then take a meter reading. Take two additional readings. *Refer* to the Brookfield viscometer manual for proper operation.

Calculations:

Calculate the viscosity of the sample as follows:

$$\text{Viscosity} = A \times 2$$

A = Average of the three meter readings

2 = Conversion factor found in the Brookfield manual for spindle #1 @30 rpm's.

NOTE: When reporting the viscosity of the solution, always include the temperature, 74.5°–75.5° F. (23.6°–24.2° C.).

EXAMPLES

The following examples further describe and demonstrate the preferred embodiments within the scope of the present invention. The Examples are given solely for the purpose of illustration and are not to be construed as limitations of the present invention as many variations thereof are possible without departing from its spirit and scope. Unless otherwise indicated, all percentages and ratios herein are by weight.

In addition to the examples is a Skin Feel Test Procedure and the results thereof (Tables 1 and 2) that demonstrate the differences in both in-use slipperiness and ease of rinsing for HEC-thickened products vs. Jaguar and salt-thickened products.

SKIN FEEL TEST (FOREARMS)

Procedure:

*Pre-Wash,* Panelists were aksed to first wash both forearms using CAMAY® toilet bar soap. After rinsing, while the arms where still wet, an initial skin friction reading (using a Skin Friction Meter, Ser. No. 595108, made by the Department of Engineering, University of Newcastle, Newcastle, England) was made on both forearms. Two syringes were then filled with 1.0 ml of two of the three products to be tested.

*In-Use Slipperiness.* With arms still wet, the first product was delivered to the palm of the right hand. The product was then rubbed on the underside of the left forearm for 10 strokes (1 stroke is defined as rubbing the forearm from the wrist to the inside crease of the elbow and back to the wrist). The second product was immediately delivered to the left palm and rubbed on the underside of the right arm for 10 strokes. At this point, a skin friction reading was taken with the products still on the arms. Results are shown in Table 1.

*Ease of Rinsing.* Panelists were then asked to rinse each arm separately, counting the number of bare hand strokes needed to completely rinse the product off their forearms. Results are shown in Table 2.

TABLE 1

Skin Friction Meter Results
(In-Use Slipperiness)
Skin friction data of product on skin correlate with expected in-use slipperiness based on the skin feel agents used in the following products. Examples A, B and C listed below describe the three formulas used in this test.

| Component | A | B | C[1] |
|---|---|---|---|
| Sodium Lauryl Ethoxy (3) Sulfate Solution (28.5% solution) | 39.3% | 38.5% | 21.5% |
| Sodium Lauryl Sulfate Solution (28.5% solution) | 32.2 | 31.6 | N/A |
| Coconut Monoethanolamide | 4.0 | 4.0 | N/A |
| Coconut Diethanolamide | — | — | 2.2 |
| Perfume | 3.0 | 2.0 | N/A |
| Ethylene Glycol Distearate | 1.0 | 1.0 | N/A |
| Ethylene Diamine Tetraacetic Acid | 0.1 | 0.1 | N/A |
| Preservatives | 0.25 | 0.25 | N/A |
| Color Solution | 0.8 | 1.1 | N/A |
| Citric Acid | 0.25 | 0.12 | N/A |
| Sodium Chloride | 0.1 | 0.1 | 0.5 |
| Jaguar HP-60 | 0.55 | — | N/A |
| Natrosol 250 | — | 0.2 | N/A |
| Propylene Glycol | 9.0 | 3.0 | 3.5 |
| Distilled Water | Balance | Balance | Balance |
| | 100.00% | 100.00% | 100.00% |

[1]Commercially available FA Bath Foam made by Henkel Co.
N/A = Data not available.

The Neat and Dilute Viscosities of the above liquid cleansers, Examples A, B and C, are shown in the FIGURE as Curves 1, 3 and 4, respectively. The skin friction reduction results are as follows:

| Product | % Reduction of Skin Friction with Product |
|---|---|
| A - with Jaguar gum | 70% |
| B - with HEC | 62% |
| C - without skin feel agent (salt thickened) | 54% |

NOTE: Above results are based on a complete round robin paired comparison test using a base panel of 22–23 for each pair tested.

The confidence levels of significant differences (using the Student T test) between the three products area as follows:

| Product Comparison | % Confidence |
|---|---|
| Jaguar gum vs. no skin feel agent (salt thickened) | 99.5% |
| Jaguar gum vs. HEC | 96.0% |
| HEC vs. no skin feel agent (salt thickened) | 95.0% |

TABLE 2

Panelist Rinsing Results
(Ease of Rinsing)
Panelist product rinsing results correlate with expected ease of rinsing. The results are as follows:

| Product | Avg. No. of Strokes Req'd to Completely Rinse Product |
|---|---|
| A - with Jaguar gum | 12.2 |
| B - with HEC | 10.8 |
| C - without skin feel agent (salt thickened) | 9.7 |

NOTE: Above results are based on a complete round robin paired comparison test using a base panel of 22-23 for each pair tested.

The confidence levels of significant differences between the three products are as follows:

| Product Comparison | % Confidence |
|---|---|
| Jaguar gum vs. no skin feel agent (salt thickened) | 99+% |
| Jaguar gum vs. HEC | 88% |
| HEC vs. no skin feel agent (salt thickened) | 87% |

EXAMPLE I

A full product formula was made with 0.2% hydroxyethyl cellulose (HEC) and 3% propylene glycol. The base formulation used in this variation contained the following ingredients:

| Component | Wt. Composition |
|---|---|
| Sodium Lauryl Ethoxy (3) Sulfate Solution (28.5% solution) | 38.5% |
| Sodium Lauryl Sulfate Solution (28.5% solution) | 31.6 |
| Coconut Manoethanolamide | 4.0 |
| Perfume | 2.0 |
| Ethylene Glycol Distearate | 1.0 |
| Ethylene Diamine Tetraacetic Acid | 0.1 |
| Preservatives | 0.25 |
| Color Solution | 1.1 |
| Citric Acid | 0.12 |
| Hydroxyethyl Cellulose (HEC)[1] | 0.2 |
| Propylene Glycol | 3.0 |
| Distilled Water | Balance |
| | 100.00% |

Product Neat Viscosity = 5000 cps;
Product Dilute Viscosity = 20 cps; see Curve 3 of FIG.
[1]Natrosol 250, degree of hydroxyethyl molar substitution = 2.5, supplied by Hercules Incorporated.

The above composition was prepared in the following manner:

A cold (room temperature) mix was prepared by adding ingredients in the following order: 50% of the added distilled water, hydroxyethyl cellulose, sodium laruyl ethoxy (3) sulfate solution and 50% of the sodium lauryl sulfate solution.

A hot (60°-71.1° C., 140°-160° F.) mix was prepared by adding ingredients in the following order: 50% of the added distilled water, 50% of the sodium lauryl sulfate solution, ethylene diamine tetraacetic acid, preservatives, coconut monoethanolamide, propylene glycol and ethylene glycol distearate.

The hot mix was poured into the cold mix, with agitation.

The remaining ingredients were mixed in the following order: color solution, citric acid and perfume.

EXAMPLE II

A second full product formula was made with 0.5% hydroxyethyl cellulose (HEC) and 5% propylene glycol. The base formulation used in this variation contained the following ingredients:

| Component | Wt. Composition |
|---|---|
| Sodium Lauryl Ethoxy (3) Sulfate Solution (28.5% solution) | 38.5% |
| Sodium Lauryl Sulfate Solution (28.5% solution) | 31.6 |
| Coconut Monoethanolamine | 4.0 |
| Perfume | 3.0 |
| Ethylene Glycol Distearate | 1.0 |
| Ethylene Diamine Tetraacetic Acid | 0.1 |
| Preservatives | 0.25 |
| Color Solution | 0.39 |
| Citric Acid | 0.29 |
| Hydroxyethyl Cellulose (HEC)[1] | 0.5 |
| Propylene Glycol | 5.0 |
| Distilled Water | Balance |
| | 100.00% |

Product Neat Viscosity = 5000 cps;
Product Dilute Viscosity = 30 cps; see Curve 2 of FIG.
[1]Natrosol 250, supplied by Hercules Incorporated.

The above composition of the present invention was prepared in a manner similar to that described in Example I.

EXAMPLE III

A third full product formula was made with 0.2% hydroxyethyl cellulose (HEC) and 2% polyoxyethylene glycol (PEG 600). The base formula used in this variation contained the following ingredients:

| Component | Wt. Composition |
|---|---|
| Sodium Lauryl Ethoxy (3) Sulfate Solution (28.5% solution) | 38.5% |
| Sodium Lauryl Sulfate Solution (28.5% solution) | 31.6 |
| Coconut Monoethanolamide | 4.0 |
| Perfume | 3.0 |
| Ethylene Glycol Distearate | 1.0 |
| Ethylene Diamine Tetraacetic Acid | 0.1 |
| Preservatives | 0.25 |
| Color Solution | 0.39 |
| Citric Acid | 0.29 |
| Hydroxyethyl Cellulose (HEC)[1] | 0.2 |
| Polyoxyethylene Glycol[2] | 2.0 |
| Distilled Water | Balance |
| | 100.00% |

Product Neat Viscosity = 5000 cps;
Product Dilute Viscosity = 20 cps; see Curve 3 of FIG.
[1]Natrosol 250, supplied by Hercules Incorporated.
[2]Carbowax PEG 600, supplied by Union Carbide, having about 13 EO units.

The above composition of the present invention was prepared in a manner similar to that described in Example I.

Examples I-III demonstrated the following regarding in-use skin feel slipperiness and rinsing characteristics using the Skin Feel Test:

1. No difference in slip or ease of rinsing between the three HEC formulas of Examples I-III.

2. Less slip and easier to rinse than a similar formula, Example

A, which has 0.55% Jaguar HP-60 gum.

3. More slip and harder to rinse than formula thickened with electrolyte (NaCl), Example C.

The FIGURE shows plots of viscosity vs. dilute concentration curves with noted product skin feel attributes. As can be seen, the three HEC formula dilution curves are similar and fall in between the highly slick/-slippery formula thickened with Jaguar gum Example "A" and the less slick/slippery competitive formula thickened with electrolyte Example "C". Curve 1 represents a product, Example A, which has a high degree of slipperiness but is difficult to rinse. Curves 2 and 3 represent products, Examples II and I/III, respectively, which have the desired degree of slipperiness and ease of rinsing. Curve 4 represents a product, Example C, which has a low degree of slipperiness, but which is easy to rinse. See Methods I and II for neat and dilute viscosity procedures.

EXAMPLES IV AND V

These examples illustrate the need for a solvent, in this case propylene glycol, to achieve phase stability. Two full product formulations were prepared, one (IV) with 0% propylene glycol and the other (V) with 3% propylene glycol. The base formulation used in these variations contained the following ingredients:

| Component | Wt. Composition |
|---|---|
| Sodium Lauryl Ethoxy (3) Sulfate Solution (28.5% solution) | 38.5% |
| Sodium Lauryl Sulfate Solution (28.5% solution) | 31.6 |
| Coconut monoethanolamide | 4.0 |
| Perfume | 2.0 |
| Ethylene Glycol Distearate | 1.0 |
| Ethylene Diamine Tetraacetic Acid | 0.1 |
| Preservatives | 0.25 |
| Color Solution | 1.1 |
| Citric Acid | 0.12 |
| Hydroxyethyl Cellulose (HEC)[1] | 0.2 |
| Propylene Glycol | 0 or 3 |
| Distilled Water | Balance |
| | 100.00% |

Product Neat Viscosity (with propylene glycol) = 4750 cps
Product Neat Viscosity (without propylene glycol) = 8000 cps
[1]Natrosol 250, supplied by Hercules Incorporated.

The above compositions of the present invention were prepared in a manner similar to that described in Example I.

Results showed the non-propylene glycol-containing formula (IV) had phase separation after only a few days; whereas the propylene glycol formula (V) of this invention remained phase stable for several months.

What is claimed is:

1. A liquid personal cleanser product consisting essentially of:

A. a thickener consisting essentially of from about 0.1% to about 1.5% of a water-soluble hydroxyethyl cellulose polymer and mixtures thereof;

B. from about 3% to about 20% of a phase stabilizing solvent selected from the group consisting of ethylene glycol, propylene glycol, and mixtures thereof;

C. from about 10% to about 50% of a synthetic surfactant;

D. from about 0.001% to about 1.0% of electrolyte in addition to ingredients A–C;

E. from about 50% to about 80% water; and wherein said solvents of B. have a molecular weight of from about 200 to about 10,000; and wherein said product has a neat product viscosity (100%) of from about 2,000 cps to about 12,000 cps, and a dilute product viscosity (50%) of from about 15 cps to about 95 cps and wherein said liquid cleansing product is substantially a single phase product.

2. A liquid cleansing product according to claim 1 wherin said hydroxyethyl cellulose has a molar substitution of from about 1.5 to about 3.0.

3. A liquid cleansing product according to claim 2 wherein the hydroxyethyl cellulose is present at a level of from about 0.1% to about 1.0% and has a molar substitution of from about 2.0 to about 3.0.

4. A liquid cleansing product according to claim 1 wherein the surfactant is present at a level of from about 10% to about 30%.

5. A liquid cleansing product according to claim 4 wherein the surfactant is an anionic surfactant.

6. A liquid cleansing product according to claim 5 wherein the anionic surfactant is selected from the group consisting of sodium alkyl glycerol ether sulfonate, sodium lauroyl sarcosinate, sodium alkyl sulfate, sodium ethoxy (1–12) alkyl sulfate and mixtures thereof.

7. A liquid cleansing product according to claim 1 wherein said product has a neat viscosity (100%) of from about 4,000 cps to about 10,000 cps and a dilute product viscosity (50%) of from about 20 cps to about 60 cps.

8. A liquid cleansing product according to claim 7 wherein said product contains from about 1% to about 5% of an alkanolamide of a fatty acid having from about 8 to about 18 carbon atoms.

9. A liquid cleansing product according to claim 7 wherein said product contains from about 0.1% to about 10% of an opacifier selected from the group consisting of ethylene glycol distearate, talc and mixtures thereof.

10. The liquid cleansing product according to claim 1 wherein said polymeric solvents of B. have molecular weights of from about 400 to about 800.

11. A liquid personal cleansing product consisting essentially of:

A. a thickener consisting essentially of from about 0.1% to about 1.5% of a water-soluble hydroxyethyl cellulose polymer and mixtures thereof;

B. from about 3% to about 10% of a phase stabilizing solvent selected from the group consisting of ethylene glycol, propylene glycol, polyoxyethylene glycol, polyoxypropylene glycol, mixed block copolymers of polyoxyethylene glycol and polyoxypropylene glycol, and mixtures thereof;

C. from about 10% to about 50% of a synthetic surfactant;

D. from about 0.001% to about 1.0% of electrolyte in addition to ingredients A–C;

E. from about 50% to about 80% water; and wherein said solvents of B. have a molecular weight of from about 200 to about 10,000; and wherein said product has a neat product viscosity (100%) of from about 2,000 cps to about 12,000 cps, and a dilute product viscosity (50%) of from about 15 cps to about 95 cps and wherein said liquid cleansing product is substantially a single phase product.

* * * * *

UNITED STATES PATENT AND TRADEMARK OFFICE

CERTIFICATE OF CORRECTION

PATENT NO. : 4,917,823

DATED : April 17, 1990

INVENTOR(S) : ROBERT J. MAILE, Jr.

It is certified that error appears in the above-identified patent and that said Letters Patent is hereby corrected as shown below:

Col. 2, line 50, "reaons" should read -- reasons --.

Col. 2, line 57, "THe" should read -- The --.

Col. 2, line 59, "mean" should read -- men --.

Col. 3, line 44, "blcok" should read -- block --.

Col. 3, line 49, "about0.5%" should read -- about 0.5% --.

Col. 3, line 49, "abotu" should read -- about --.

Col. 4, line 33, "prpylene" should read -- propylene --.

Col. 5, lines 24-25, "steryldimethylphosphine" should read -- stearyldimethylphosphine --.

Col. 5, line 31, "eleyldimethylphosphine" should read -- oleyldimethylphosphine --.

Col. 5, line 33, "alkyl" should read -- dialkyl --.

Col. 5, line 34, "hydroyx" should read -- hydroxy --.

Col. 5, line 47, "braodly" should read -- broadly --.

Col. 5, line 68, "orphosphorus" should read -- or phosphorus --.

Col. 6, line 8, "3=[P,P-P-diethyl-P-3,6," should read -- 3-[P,P-P-diethyl-P-3,6, --.

Col. 7, lines 9-10, delete "the ethoxyanionic surfactants, particularly the alkyl sulfates," .

Col. 9, line 58, "where" should read -- were --.

UNITED STATES PATENT AND TRADEMARK OFFICE

CERTIFICATE OF CORRECTION

PATENT NO. : 4,917,823

DATED : April 17, 1990

INVENTOR(S) : ROBERT J. MAILE, Jr.

It is certified that error appears in the above-identified patent and that said Letters Patent is hereby corrected as shown below:

IN THE CLAIMS:

Col. 13, line 58, after "propylene glycol," insert -- polyoxyethylene glycol, polyoxypropylene glycol, mixed block copolymers of polyoxyethylene glycol and polyoxypropylene glycol, --.

Col. 13, line 65, "wherein" should start a new paragraph.

Col. 14, line 59, "wherein" should start a new paragraph.

Signed and Sealed this

Twenty-fifth Day of February, 1992

*Attest:*

HARRY F. MANBECK, JR.

*Attesting Officer*

*Commissioner of Patents and Trademarks*